US008083256B2

(12) United States Patent
Yamazaki

(10) Patent No.: US 8,083,256 B2
(45) Date of Patent: Dec. 27, 2011

(54) APPARATUS INCLUDING IGNITER ASSEMBLY

(75) Inventor: Masayuki Yamazaki, Tatsuno (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 12/780,734

(22) Filed: May 14, 2010

(65) Prior Publication Data

US 2010/0236439 A1 Sep. 23, 2010

Related U.S. Application Data

(62) Division of application No. 11/850,569, filed on Sep. 5, 2007, now Pat. No. 7,744,124.

(60) Provisional application No. 60/825,042, filed on Sep. 8, 2006.

(30) Foreign Application Priority Data

Sep. 5, 2006 (JP) ..... 2006-239916

(51) Int. Cl.
*B60R 21/26* (2011.01)

(52) U.S. Cl. ..... 280/736; 280/741; 102/200

(58) Field of Classification Search ..... 280/736, 280/741; 102/530, 531, 200
See application file for complete search history.

(56) References Cited

U.S. PATENT DOCUMENTS

| | | | | |
|---|---|---|---|---|
| 5,487,559 | A | 1/1996 | Headley | |
| 5,602,359 | A | 2/1997 | Hambro et al. | |
| 6,823,796 | B1 | 11/2004 | Amano | |
| 7,125,041 | B2 | 10/2006 | Kato et al. | |
| 7,185,588 | B2 | 3/2007 | Clark et al. | |
| 7,210,703 | B2 | 5/2007 | Young et al. | |
| 7,284,488 | B2 | 10/2007 | Maruyama et al. | |
| 7,401,810 | B2 * | 7/2008 | Brisighella et al. | 280/741 |
| 7,530,310 | B2 | 5/2009 | Hironaka et al. | |
| 7,614,875 | B2 * | 11/2009 | Katsuda et al. | 431/253 |
| 2004/0226472 | A1 | 11/2004 | Oda | |
| 2004/0245753 | A1 | 12/2004 | Kato et al. | |
| 2004/0251667 | A1 | 12/2004 | Harada et al. | |
| 2006/0207459 | A1 | 9/2006 | Nishina | |
| 2007/0193464 | A1 | 8/2007 | Hironaka et al. | |
| 2009/0085335 | A1 | 4/2009 | Yabuta et al. | |

FOREIGN PATENT DOCUMENTS

| | | | |
|---|---|---|---|
| EP | 1 227 016 | A1 | 7/2002 |
| EP | 1 577 633 | A1 | 9/2005 |
| EP | 1 591 159 | A1 | 11/2005 |
| JP | 2003-161599 | A | 6/2003 |
| WO | WO 2005/095163 | A1 | 10/2005 |

* cited by examiner

*Primary Examiner* — Drew Brown

(74) *Attorney, Agent, or Firm* — Birch, Stewart, Kolasch & Birch, LLP

(57) ABSTRACT

An apparatus provided with an igniter assembly includes, an igniter main body having an ignition portion, provided with an ignition agent, and an electoroconductive pin, a resin portion surrounding at least part of the igniter main body and a substantially cylindrical igniter collar fixed to an outer surface of the resin portion. The igniter assembly is disposed in an opening formed in a bottom portion of a housing, the igniter collar of the igniter assembly is fixed fixed to the housing, and the igniter collar is fixed to the resin portion by deforming the igniter collar so as to engage the igniter collar with a concave portion in the resin portion.

12 Claims, 6 Drawing Sheets

APPARATUS INCLUDING IGNITER ASSEMBLY

This application is a Divisional of application Ser. No. 11/850,569 filed on Sep. 5, 2007 now U.S. Pat. No. 7,744,124 which claims priority under 35 U.S.C. §119(a) to Patent Application No. 2006-239916 filed in Japan on Sep. 5, 2006, and 35 U.S.C. §119(e) to U.S. Provisional Application No. 60/825,042 filed on Sep. 8, 2006, all of which are hereby expressly incorporated by reference into the present application.

BACKGROUND OF INVENTION

1. Field of Invention

The present invention relates to an apparatus including an igniter assembly suitable as an inflator for use in a restraining system of a vehicle.

2. Description of Related Art

An igniter assembly is known in which an igniter main body is integrated with a metal collar by a resin, this igniter main body including an ignition agent, a bridge wire for igniting the ignition agent, and electroconductive pins for supplying an electric current for heating the bridge wire.

Where a small gap is formed between the igniter collar and resin due to shrinkage of resin during cooling after injection, moisture penetrates into the gap, causing corrosion and increasing the gap. Therefore, a portion of the collar that comes into contact with the resin has to be subjected to anticorrosive treatment, which rises cost of components.

U.S. Pat. No. 5,487,559 discloses a gas generator 20. An adapter 170 is attached to the bottom surface of the gas generator 20. The adapter 170 forms therein an annular portion extending from a central portion of the bottom surface inward a container 22. Because the annular portion is tapered, there is a portion protruding inwardly in the radial direction. An igniter main body is formed by attaching a can 120 filled with a charge 150 onto a header 40 connected by terminals 60, 80, and the igniter main body is assembled with the adapter 170 by a plastic 160.

Usually injection molding of resins is used with such metal parts having a complex shape, and anticorrosive treatment is necessary to prevent the aforementioned occurrence of corrosion.

SUMMARY OF INVENTION

The present invention relates to (1) an apparatus provided with an igniter assembly including:

- an igniter main body having an ignition portion, provided with an ignition agent, and an electoroconductive pin, a resin portion surrounding at least part of the igniter main body and a substantially cylindrical igniter collar fixed to an outer surface of the resin portion,
- the igniter assembly being disposed in an opening formed in a bottom portion of a housing,
- the igniter collar of the igniter assembly being fixed to the housing,
- the igniter collar fixing to the resin portion by deforming the igniter collar so as to engage the igniter collar with a concave portion in the resin portion.

The igniter assembly may be disposed in relation to the opening formed in the bottom portion of the housing.

The present invention relates to (2) an apparatus provided with an igniter assembly including:

- an igniter main body having an ignition portion, provided with an ignition agent, and an electoroconductive pin, a resin portion surrounding at least part of the igniter main body and a substantially cylindrical igniter collar fixed to an outer surface of the resin portion,
- the igniter assembly being disposed in an opening formed in a bottom portion of a housing,
- the igniter collar being formed by integrating a circumferential edge of the opening in the bottom portion of the housing with a substantially cylindrical member,
- the igniter collar fixing to the resin portion by deforming the igniter collar so as to engage the igniter collar with a concave portion in the resin portion.

The present invention relates to (3) an apparatus provided with an igniter assembly including:

- an igniter main body having an ignition portion, provided with an ignition agent, and an electoroconductive pin, a resin portion surrounding at least part of the igniter main body and a substantially cylindrical igniter collar fixed to an outer surface of the resin portion,
- the igniter assembly being disposed in an opening formed in a bottom portion of a housing,
- in the igniter assembly, part including the ignition portion being at least covered with a bottomed tubular member, the igniter collar of the igniter assembly being formed by integrating a circumferential edge of the opening in the bottom portion of the housing, a substantially cylindrical member and a circumferential edge of an opening of the bottomed tubular member,
- the igniter collar fixing to the resin portion by deforming the igniter collar so as to engage the igniter collar with a concave portion in the resin portion.

The present invention relates to a method of assembling an apparatus provided with an igniter assembly, comprising the steps of:

- inserting an intermediate body, including the igniter main body and the resin portion and having a concave portion in a circumferential surface of the resin portion, into the substantially cylindrical igniter collar integrated with the housing; and
- applying a pressure to the portion of an outer circumferential surface of the igniter collar that is directly opposite the concave portion of the resin portion to cause deformation into a shape matching that of the convex portion of the resin portion, and fixing the resin portion to the igniter collar.

BRIEF DESCRIPTION OF THE DRAWINGS

The present invention will become more fully understood from the detailed description given hereinbelow and the accompanying drawings which are given by way of illustration only, and thus are not limitateive of the present invention and wherein.

DETAILED DESCRIPTION OF INVENTION

Figure 1:
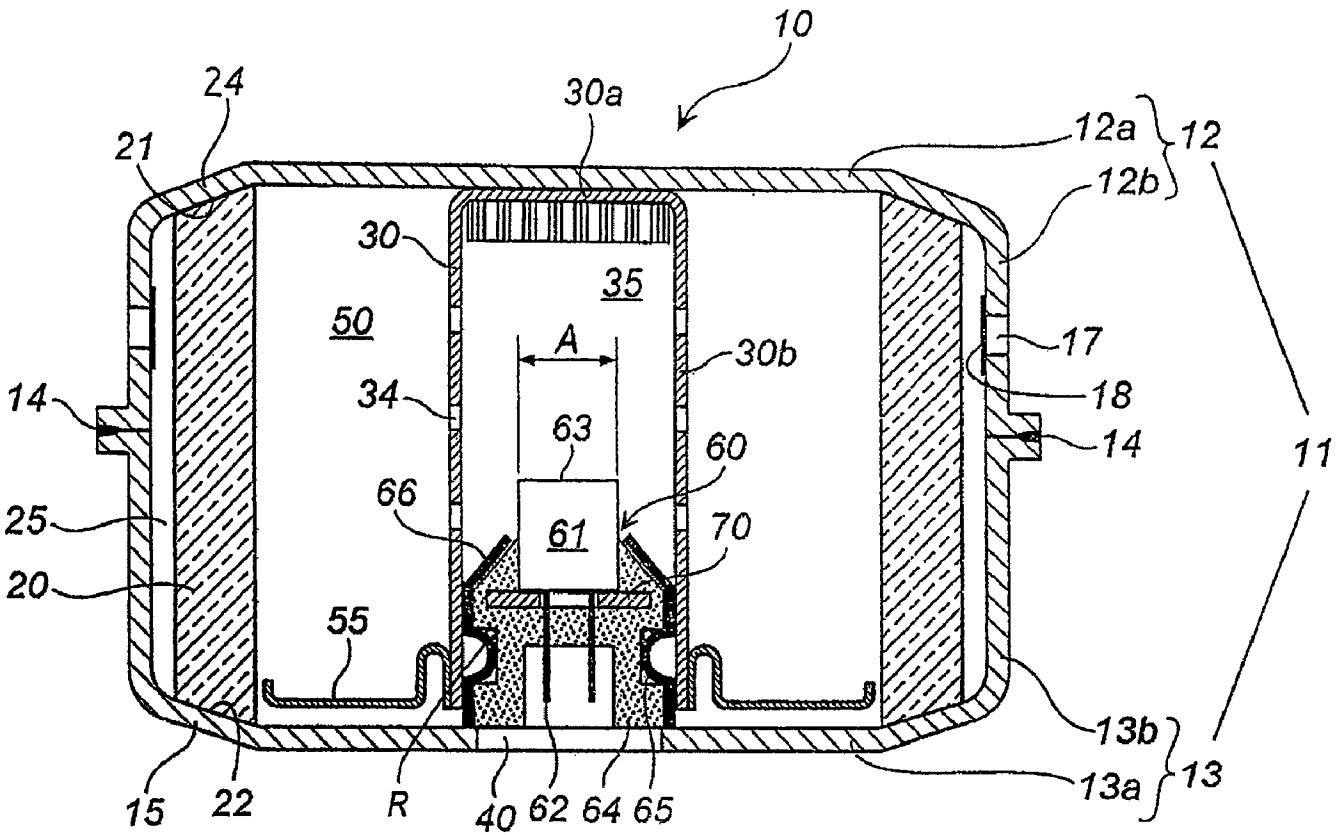
FIG. 1 shows a vertical cross-sectional view of the apparatus (gas generator) in accordance with the present invention.

The present invention provides an apparatus including an igniter assembly that is easy to assemble and enables the reduction in production cost and also provides a method of assembling the apparatus.

In conventional arts, a resin is injection-molded into a collar in order to integrate the collar and an igniter main body, but in the present invention the resin for fixing the igniter main body is assembled with the collar, and both are fixed and sealed.

The apparatus including an igniter assembly in accordance with the present invention is suitable as an inflator for use in a restraining system of a vehicle, and this inflator may use a gas generating agent, a pressurized gas, or a combination of gas generating agent and pressurized gas as a gas source.

In the igniter assembly used in the invention of apparatus (1), the surface of the metallic igniter collar is deformed into a convex shape which corresponds to the concave portion of the resin portion and the convex portion is inserted into the concave portion, thereby joining and integrating them.

The igniter collar and the housing are separate members, and the igniter collar is fixed by welding to the housing at a stage prior to attaching the igniter main body integrated with the resin portion.

The concave portion of the resin portion may be a groove continuous in the circumferential direction, a discontinuous groove, and a plurality of independent recesses, but from the standpoint of increasing sealing ability (moisture resistance), a groove continuous in the circumferential direction is preferred. One, two, or more aforementioned grooves may be provided.

The resin forming the resin portion can be selected from Nylon 6-12, polyallylate, polybutylene terephthalate, polyphenylene sulfide, or a liquid-crystalline polymer described in a known igniter assembly (for example, JP-A No. 2003-161599).

No specific limitation is placed on a metal for use in an igniter collar. However, in accordance with the present invention, the surface of the igniter collar that is in contact with the resin portion is not required to be subjected to anticorrosive treatment. Therefore inexpensive iron can be used.

The invention of apparatus (2) is different from the invention of apparatus (1) in that the igniter collar is integrated with the circumferential edge of the opening of the bottom portion of the housing and a substantially tubular member. The circumferential edge of the opening of the bottom portion of the housing and the substantially tubular member may be integrated by welding and may be formed integrally in advance.

The invention of apparatus (3) is different from the invention of apparatus (1) in that the igniter collar is formed by integrating the circumferential edge of the opening of the bottom portion of the housing, the substantially cylindrical member and the circumferential edge of the opening of the bottomed tubular member. The circumferential edge of the opening of the bottom of the housing and the circumferential edge of the opening at one end of the of the substantially cylindrical member may be welded and then the circumferential edge of the opening at the other end of the substantially cylindrical member may be integrated with the circumferential edge of the opening of the bottomed tubular member by welding, or the three members may be formed integrally in advance.

The bottomed tubular member (only an opening at one end of the tube is closed) is an accommodation chamber of the igniter assembly and can serve as a flame-transferring chamber that is filled with a transfer charge or a combustion chamber that is filled with a gas generating agent.

The present invention further relates to the apparatus provided with an igniter assembly, wherein the igniter assembly has an annular holding plate having a hole and embedded in the resin portion;

the annular holding plate is positioned between at least two reduced diameter portions formed separately in the axial direction of the igniter collar, and the annular holding plate is disposed so that the electroconductive pin passes inside through the hole; and an outer diameter of the annular holding plate is larger than inner diameters of the two reduced diameter portions, and an inner diameter of the annular holding plate is less than an outer diameter of the ignition portion of the igniter main body.

By providing such annular holding plate, it is possible to prevent the igniter main body from falling off even when the resin of the resin portion is melted by heat generated during actuation of the igniter assembly. The annular holding plate can be made from a metal and be from the same material as the igniter collar.

The present invention further relates to the apparatus provided with an igniter assembly, wherein the annular holding plate protrudes at an outer surface of the resin portion and forms at least part of a wall surface of a concave portion of the resin portion.

If a circumferential edge portion of the annular holding plate protrudes at an outer surface of the resin portion and forms part of a wall surface of a concave portion, even when the resin is deformed under the effect of heat and the igniter main body abuts, under pressure, against the annular holding plate as if trying to fall off, because the protruding portion is pressed against the reduced diameter portion, the igniter main body is prevented from falling off.

The present invention further relates to the apparatus provided with an igniter assembly, wherein in a contact portion of the igniter collar and the concave portion of the resin portion, a sealing member is inserted between the igniter collar and the concave portion of the resin portion.

By inserting a deformable sealing member such as a resin or a rubber O-ring, it is possible to improve sealing ability.

The present invention further relates to the apparatus provided with an igniter assembly, wherein the housing is obtained by joining a diffuser shell having a gas discharge port and a closure shell, the closure shell has at least a flat bottom surface and a circumferential wall surface, and a height ($h_1$) of the circumferential wall surface of the closure shell and a height ($h_2$) of a deformed portion of the igniter collar, based on the flat bottom surface of closure shell, satisfy the relationship $h_2>h_1$.

The igniter collar and resin portion are fixed by deforming the igniter collar so that it mates with the convex portion of the resin portion, but in this process, an arm portion of the tool used for deforming the igniter collar applies pressure and causes deformation in a state of sandwiching (or surrounding) the igniter collar from the outside. Therefore, where the aforementioned relationship $h_2>h_1$ is satisfied, the circumferential wall does not become an obstacle when the igniter collar is sandwiched by the arm portion. As a consequence, the deformation process is facilitated. The height ($h_2$) of the deformed portion of the igniter collar is preferably a height to the central portion through lower end portion of the deformed portion having a constant width.

The intermediate body means an igniter assembly in which the igniter main body is surrounded by a resin in a state before the igniter collar is attached.

By applying such assembling method, a step of injection molding the resin and a step of welding and fixing to the housing in a state of igniter assembly are not required. Therefore, assembling is facilitated, production cost is reduced, and welding heat produces no effect on the igniter main body or resin.

The present invention further relates to the method of assembling an apparatus provided with the igniter assembly, wherein a collar which has a first reduced diameter portion formed in an opening at one end thereof, and in which an inner diameter of the first reduced diameter portion is more than an outer diameter of an ignition portion of the igniter assembly and less than an outer diameter of the resin portion, is used as the substantially cylindrical igniter collar; and when the intermediate body is inserted into the igniter collar, the insertion is performed till the resin portion abuts against the first reduced diameter portion.

When the intermediate body is inserted into the igniter collar, the insertion may be performed till the resin portion abuts against the first reduced diameter portion. Therefore, the deformation position of the igniter collar in the next step can be easily determined.

The present invention further relates to the method of assembling an apparatus provided with the igniter assembly, wherein a collar having a first reduced diameter portion formed in an opening at one end side thereof and a second reduced diameter portion formed in the axial direction separately from the first reduced diameter portion is used as the substantially cylindrical igniter collar;

a body in which an annular holding plate is embedded in the resin portion, an outer diameter of the annular holding plate is larger than inner diameters of the first reduced diameter portion and the second reduced diameter portion, and in which an inner diameter of the annular holding plate is less than an outer diameter of an ignition portion of the igniter main body, is used as the intermediate body; and the intermediate body is inserted so that the annular holding plate of the resin portion is positioned between the first reduced diameter portion and the second reduced diameter portion.

By using the intermediate body having such annular holding plate and by inserting the intermediate body so that the position thereof is between two reduced diameter portions, the igniter main body is prevented from falling off even when the resin of the resin portion is melted by heat generated during actuation of the igniter assembly.

In the gas generator in accordance with the present invention, the igniter assembly can be easily assembled and attached to the housing, and anticorrosive treatment of the igniter collar typical for prior art is unnecessary. Therefore, the production cost is reduced.

Embodiments of Invention (1) Gas Generator of FIG. 1 and Method for Assembling the Same <Gas generator>

Figure 2:
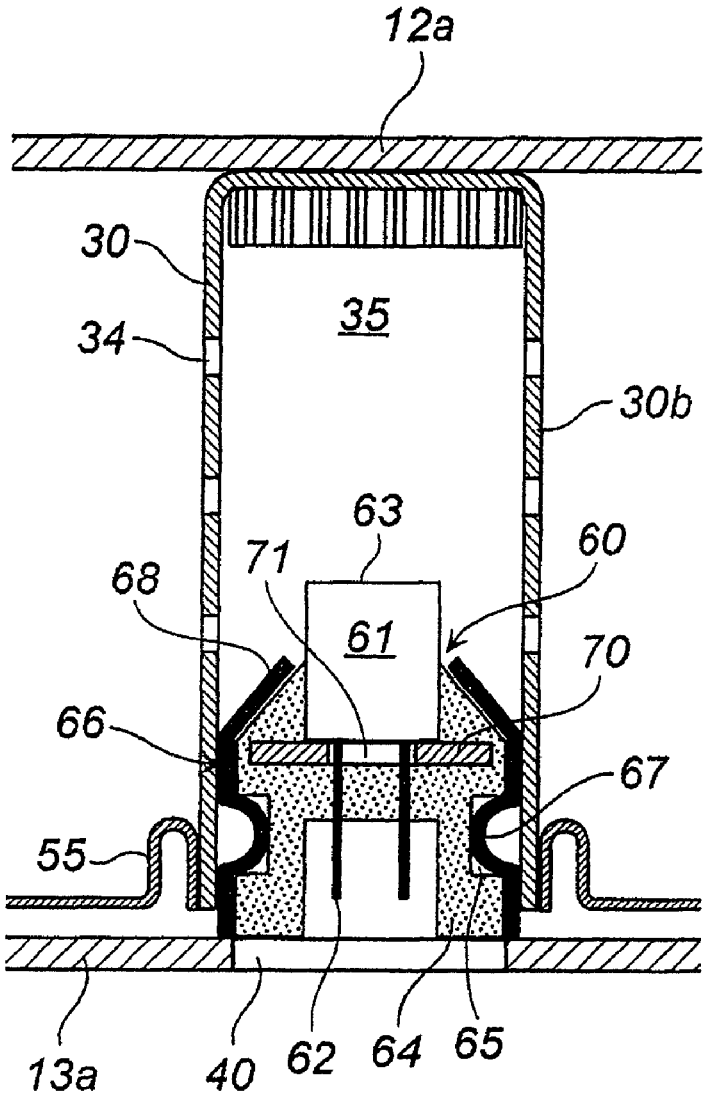
FIG. 2 shows a partial enlarged view of FIG. 1.

An example of applying the present invention to a gas generator for a restraining device of a vehicle will be described below. FIG. 1 is a vertical cross-sectional view of the gas generator. FIG. 2 is a partial enlarged view of FIG. 1.

In a gas generator 10, an outer shell container is formed by a housing 11 obtained by joining a diffuser shell 12 forming a top plate 12*a* and a circumferential wall 12*b* and a closure shell 13 forming a bottom plate 13*a* and a remaining circumferential wall 13*b*.

The diffuser shell 12 and closer shell 13 are joined by laser welding or the like in a welding portion 14, this welding forming a single circumferential wall (combination of the circumferential walls 12*b* and 13*b*).

An upper annular inclined surface 24 is provided in an annular contact portion between the top plate 12*a* and circumferential wall portion 12*b* of the diffuser shell 12, and a lower annular inclined surface 15 is provided in an annular contact portion between the bottom plate 13*a* and circumferential wall portion 13*b* of the closure shell 13.

A predetermined number of gas discharge ports 17 are provided in the diffuser shell 12, and the ports are closed with an aluminum seal tape 18 to prevent moisture permeation.

A cylindrical filter 20 is disposed inside the housing 11. Both end surfaces 21, 22 of the cylindrical filter 20 are brought into contact with the upper annular inclined surface 24 and lower annular inclined surface 15, and the two end surfaces 21, 22 and the upper and lower annular inclined surfaces 14, 15 are pressed against each other in the axial direction of the housing 11 to improve a short-pass prevention effect. A well-known filter can be used as the cylindrical filter 20.

The cylindrical filter 20 is disposed so that a gap 25 is formed between the filter and the circumferential wall portions 12*b*, 13*b*. Because of this gap 25, the generated gas can pass through the entire region of the cylindrical filter 20, thereby improving filtration and cooling of the generated gas.

A bottomed tubular member 30 is disposed concentrically with the housing 11 inside the housing 11. The bottomed tubular member 30 has a top portion 30*a* and a circumferential wall portion 30*b*. The inside of the bottomed tubular member serves as a first combustion chamber 35, and the space outside thereof serves as a second combustion chamber 50.

A predetermined amount of a first gas generating agent (not shown in the drawing) and an igniter assembly 60, both serving as an ignition device, are accommodated inside the first combustion chamber 35. A second gas generating agent (not shown in the drawing) is accommodated in the second combustion chamber 50. A retainer 55 adjusts the volume of the second combustion chamber according to the accommodated amount of the gas generating agent. The first gas generating agent is used for gas generation to ignite and combust the second gas generating agent 60 due to the activation of the igniter assembly 60. In addition, gas generated by the combustion of the first gas generating agent itself is also used for airbag inflation.

A plurality of communication holes 34 are provided at equal intervals in the circumferential direction and axial direction in the circumferential wall portion 30*b*, and the first combustion chamber 35 and second combustion chamber 50 are communicated with each other via the communication holes 34. The communication holes 34 are closed from the outer side with an aluminum sealing tape (not shown in the drawing). Because the communication holes 34 of such an arrangement are present, flame and high-temperature gas generated from the first combustion chamber 35 uniformly propagate into the second combustion chamber 50 and, therefore, ignition ability of the second gas generating agent inside the second combustion chamber 50 is improved.

The igniter assembly 60 has an igniter main body 63 including an ignition portion 61, provided with an ignition agent, and electroconductive pins 62, a resin portion 64 surrounding at least part of the igniter main body 63 and a substantially cylindrical igniter collar 66 fixed to the outer surface of the resin portion 64.

The igniter assembly 60 is disposed in an opening 40 formed in the bottom plate 13*a* of the closure shell, and an opening at the lower end of the igniter collar 66 is fixed by welding to the bottom plate 13*a* of the closure shell.

The resin portion 64 has a groove portion 65 continuous in the circumferential direction on the circumferential surface. An annular holding plate 70 is embedded in the radial direction in the resin portion 64, and two electroconductive pins 62 pass through the inside of a hole 71 in the annular holding plate 70.

The igniter collar 66 has a substantially cylindrical shape. An opening therein on the side of the ignition portion 61 has a reduced diameter and an inward flange portion 68 (first reduced diameter portion 68) is formed. An inward annular convex portion (second reduced diameter portion) 67 that is deformed to engage with the groove portion 65 of the resin portion 64 (pressed in from the outside and caused to recede inwardly) is provided in the circumferential surface of the igniter collar. The resin portion 64 and igniter collar 66 are fixed to each other by fitting the annular convex portion 67 into the groove portion 65. A sealing member such as an O-ring R can be inserted between the groove portion 65 and annular convex portion 67. A portion of the bottomed tubular member 30 that is directly opposite to the annular convex portion 67 also can be pressed in and deformed to engage with the annular convex portion 67 and fix the bottomed tubular member 30.

The outer diameter of the annular holding plate 70 is larger than the inner diameters of the first reduced diameter portion 68 and second reduced diameter portion 67 of the igniter collar 66, and the inner diameter of the hole 71 of the annular holding plate 70 is smaller than an outer diameter A of the ignition portion 61. Therefore, even when the resin of the resin portion 64 is melted by heat generated during actuation of the igniter assembly 60, the igniter main body 63 and annular holding plate 70 are prevented from separating and falling out from the opening 40.

Operation of the gas generator shown in FIG. 1 will be described below. When an automobile collides, the igniter assembly 60 is actuated by a signal from an impact sensor, the first gas generating agent stored in the first combustion chamber 35 is ignited and combusted, and flame and high-temperature gas are generated. The flame and high-temperature gas are ejected from a plurality of communication holes 34 (the sealing tape closing the communication holes 34 is ruptured) provided in the bottomed tubular member 30 into the second combustion chamber 50, the second gas generating agent is ignited and combusted, and gas serving as an airbag inflation medium is generated.

<Method for Assembling the Gas Generator>

Figure 3:
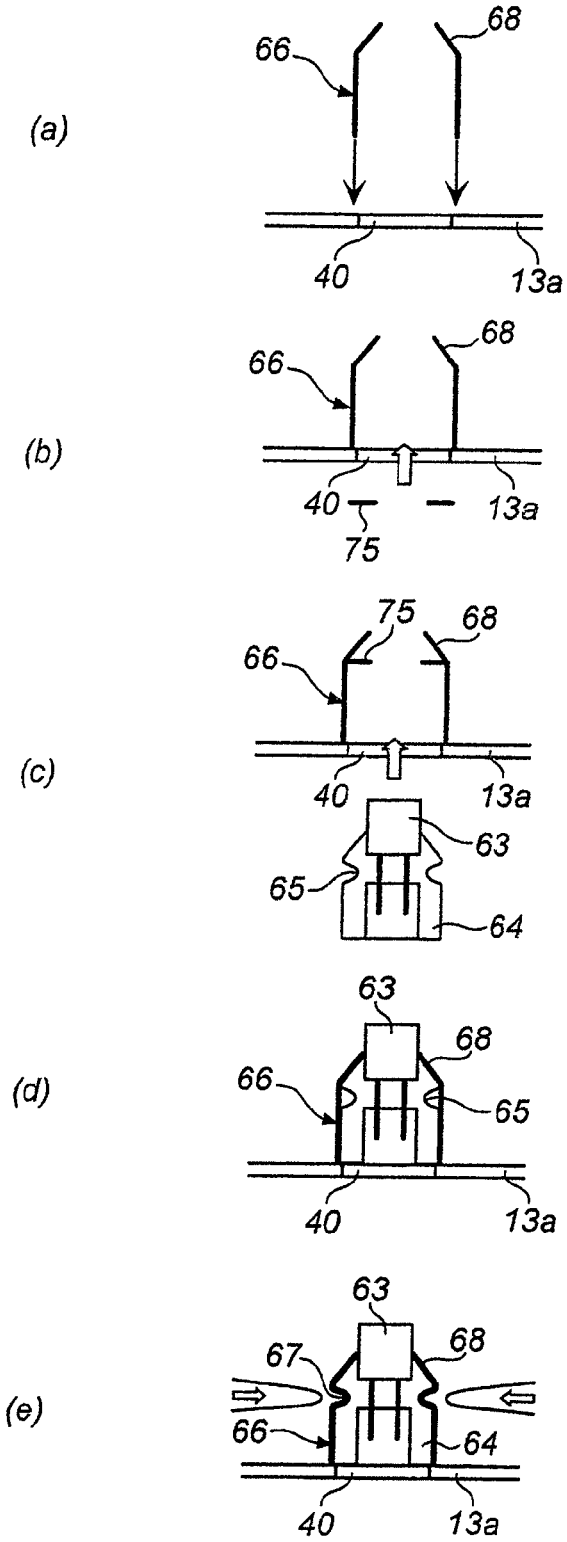
FIG. 3 shows an explanatory drawing illustrating a method of assembling the gas generator of FIG. 1.

A method of assembling the gas generator shown in FIG. 1 and FIG. 2 will be described below. FIG. 3 is an (a) to (e) process diagram illustrating a method of attaching the igniter assembly to the housing in the assembly method of the gas generator shown in FIG. 1 and FIG. 2.

Step (a)

The igniter collar 66 having an inner diameter equal to the inner diameter of the opening 40 formed in the bottom plate 13*a* of the closure shell is fixed by welding to the circumferential edge of the opening 40. The inward flange portion (first reduced diameter portion) 68 is formed in the igniter collar 66 in advance.

Step (b)

A gasket 75 is then disposed inside the igniter collar 66. The gasket 75 is stuck by the inward flange portion 68 and stopped.

Steps (c), (d)

An intermediate body that is the igniter main body 63 surrounded with the resin 64 having the groove portion 65 is inserted into the igniter collar 66. At this time, the gasket 75 is kept pressed, by the intermediate body, against the inward flange portion 68. The outer diameter of the resin portion 64 is almost equal to the inner diameter of the igniter collar 66. A sealing member such as an O-ring R may be fitted into the groove portion 65.

Step (e)

A portion of the circumferential surface of the igniter collar 66 that is directly opposite to the groove portion 65 is pushed in and caused to recede, thereby forming the annular convex portion 67. The annular convex portion 67 is inserted into the groove portion 65 and the two are fixed to each other.

Figure 4:
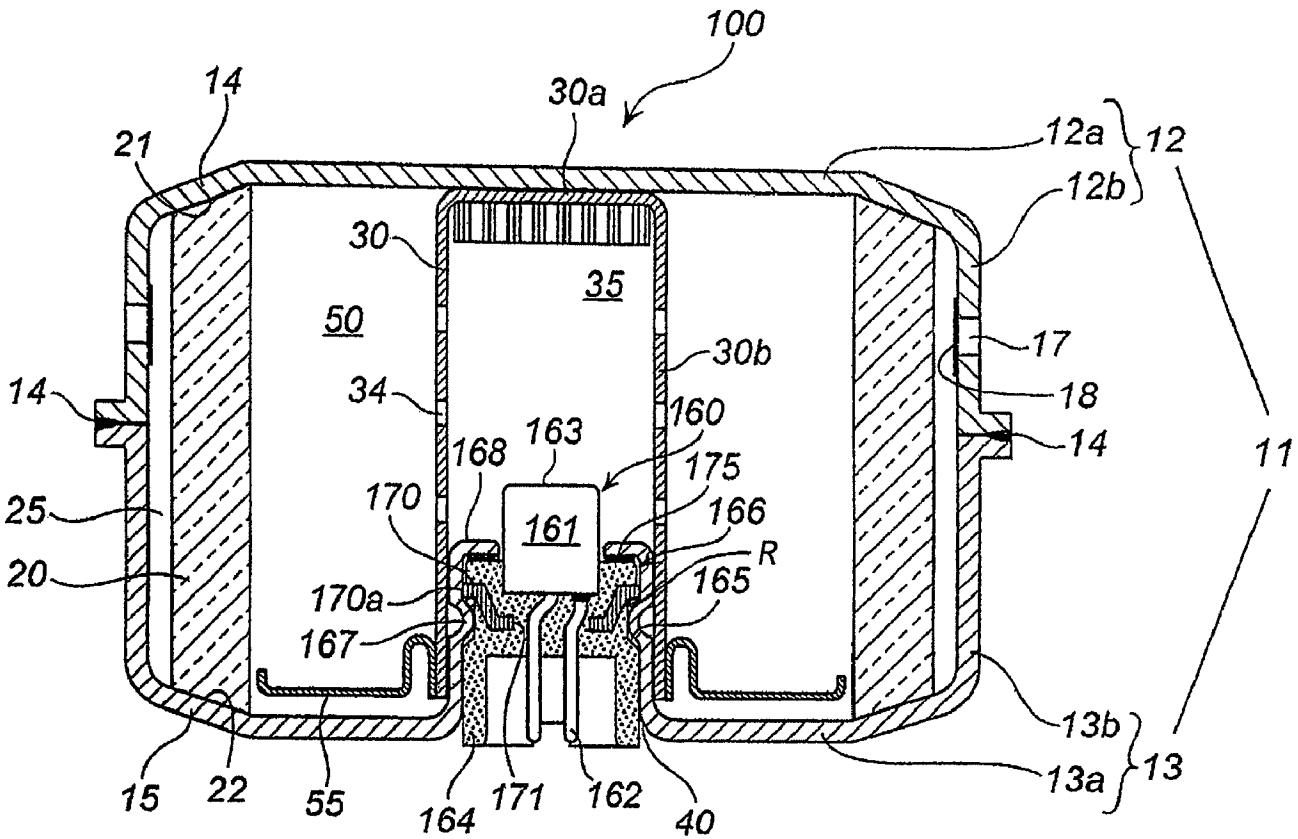
FIG. 4 shows a vertical cross-sectional view of a apparatus (gas generator) of another embodiment.

(2) Gas Generator of FIG. 4

FIG. 4 is a vertical sectional view of a gas generator of another embodiment of the present invention. A gas generator 100 of FIG. 4 is identical to the gas generator 10 of FIG. 1, except that the attachment structure of the igniter assembly is different, and the reference numerals identical to those of FIG. 1 refer to the identical structural elements.

An igniter assembly 160 has an igniter main body 163 including an ignition portion 161, provided with an ignition agent, and electroconductive pins 162, a resin portion 164 surrounding at least part of the igniter main body 163, and a substantially cylindrical igniter collar 166 fixed to the outer surface of the resin portion 164.

The resin portion 164 has a groove portion 165 that is continuous in the circumferential direction on the circumferential surface. An annular holding plate 170 in the form of a shallow saucer is embedded in the radial direction in the resin portion 164, and two electroconductive pins 162 pass through the inside of a hole 171 in the annular holding plate 170. A distal end portion 170*a* of the annular holding plate 170 slightly protrudes from the outer surface of the resin portion 164.

In the igniter collar 166, a cylindrical member (for example, a member similar in shape to the igniter collar 66 shown in Step (a) of FIG. 3) and a circumferential edge of an opening 40 of a bottom surface 13*a* are integrated with each other. An opening of the igniter collar on the side of an ignition portion 161 has a reduced diameter (a first reduced diameter portion 168), and an inward annular convex portion (second reduced diameter portion) 167 that is deformed to engage with the groove portion 165 of the resin portion 164 (pressed in from the outside and caused to recede inwardly) is provided in the circumferential surface of the igniter collar. The resin portion 164 and igniter collar 166 are fixed to each other by fitting the annular convex portion 167 into the groove portion 165.

An annular gasket (rubber, resin) 175 is sandwiched between the resin portion 164 and first reduced diameter portion 168. A sealing member such as an O-ring R may be inserted between the groove portion 165 and annular convex portion 167.

The outer diameter of the annular holding plate 170 is larger than the inner diameters of the first reduced diameter portion 168 and second reduced diameter portion 167 of the igniter collar 166, and the inner diameter of the hole 171 of the annular holding plate 170 is smaller than the outer diameter of the ignition portion 161. Therefore, even when the resin of the resin portion 164 is melted by heat generated during actuation of the igniter assembly 160, the igniter main body 163 and annular holding plate 170 are prevented from separating and falling out from the opening 40.

Because the igniter collar 166 in the gas generator 100 is integrated with a bottom plate 13*a* of the closure shell, Step (a) shown in FIG. 3 becomes unnecessary, however, the gas generator can be assembled according to Steps (b) to (e) shown in FIG. 3.

Because the distal end portion 170*a* of the annular holding plate 170 protrudes from the outer surface of the resin portion 164, when the annular convex portion 167 is formed in Step (e), the distal end portion 170*a* of the annular holding plate is also pushed by the pushing force generated when the annular convex portion is formed. As a result, the gasket 175 disposed between the first reduced diameter portion 168 and resin portion 164 is compressed and, therefore, sealing ability is improved.

Figure 5:
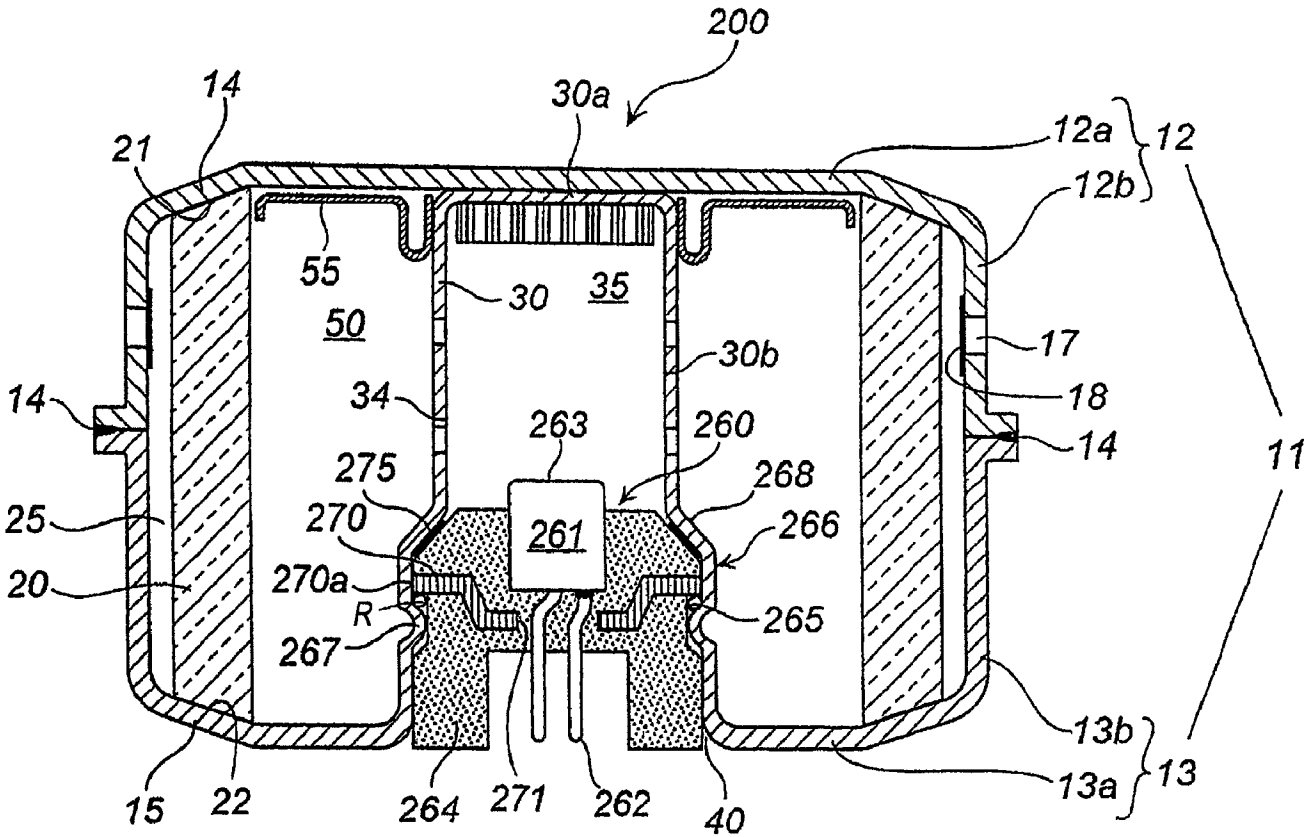
FIG. 5 shows a vertical cross-sectional view of a apparatus (gas generator) of still another embodiment.

(3) Gas Generator of FIG. 5

FIG. 5 is a vertical cross-sectional view of a gas generator of another embodiment of the present invention. A gas generator 200 of FIG. 5 is identical to the gas generator 10 of FIG. 1, except that the attachment structure of the igniter assembly is different, and the reference numerals identical to those of FIG. 1 refer to the identical structural elements. A retainer 55 is provided in a position different from that in FIG. 1, but produces the same action.

An igniter assembly 260 has an igniter main body 263 including an ignition portion 261, provided with an ignition agent, and electroconductive pins 262, a resin portion 264 surrounding at least part of the igniter main body 263 and a substantially cylindrical igniter collar 266 fixed to the outer surface of the resin portion 264.

The resin portion 264 has a groove portion 265 that is continuous in the circumferential direction on the circumferential surface. An annular holding plate 270 in the form of a shallow saucer is embedded in the radial direction in the resin portion 264, and two electroconductive pins 262 pass through the inside of a hole 271 in the annular holding plate 270. A distal end portion 270*a* of the annular holding plate 270 slightly protrudes from the outer surface of the resin portion 264.

In the igniter collar 266, a circumferential edge of an opening 40 of a bottom surface 13*a*, a cylindrical member (for example, a member similar in shape to the igniter collar 66 shown in Step (a) of FIG. 3) and a circumferential edge of an opening of a bottomed tubular member 30 are integrated with each other. An opening of the igniter collar on the side of an ignition portion 261 has a reduced diameter (a first reduced diameter portion 268), and an inward annular convex portion (second reduced diameter portion) 267 that is deformed to engage with the groove portion 265 of the resin portion 264 (pressed in from the outside and caused to recede inwardly) is provided in the circumferential surface of the igniter collar. The resin portion 264 and igniter collar 266 are fixed to each other by fitting the annular convex portion 267 into the groove portion 265.

An annular gasket (rubber, resin) 275 is sandwiched between the resin portion 264 and first reduced diameter portion 268. A sealing member such as an O-ring R can be inserted between the groove portion 265 and annular convex portion 267.

The outer diameter of the annular holding plate 270 is larger than the inner diameters of the first reduced diameter portion 268 and second reduced diameter portion 267 of the igniter collar 266, and the inner diameter of the hole 271 of the annular holding plate 270 is smaller than the outer diameter of the ignition portion 261. Therefore, even when the resin of the resin portion 264 is melted by heat generated during actuation of the igniter assembly 260, the igniter main body 263 and annular holding plate 270 are prevented from separating and falling outside from the opening 40.

Because the igniter collar 266 in the gas generator 200 is integrated with a bottom plate 13*a* of the closure shell and the bottomed tubular member 30, Step (a) shown in FIG. 3 becomes unnecessary, and the gas generator can be assembled according to Steps (b) to (e) shown in FIG. 3.

Because the distal end portion 270*a* of the annular holding plate 270 protrudes from the outer surface of the resin portion 264, when the annular convex portion 267 is formed in Step (e), the distal end portion 270*a* of the annular holding plate is also pushed by the pushing force generated when the annular convex portion is formed. As a result, the gasket 275 disposed between the first reduced diameter portion 268 and resin portion 264 is compressed and, therefore, sealing ability is improved.

Figure 6:
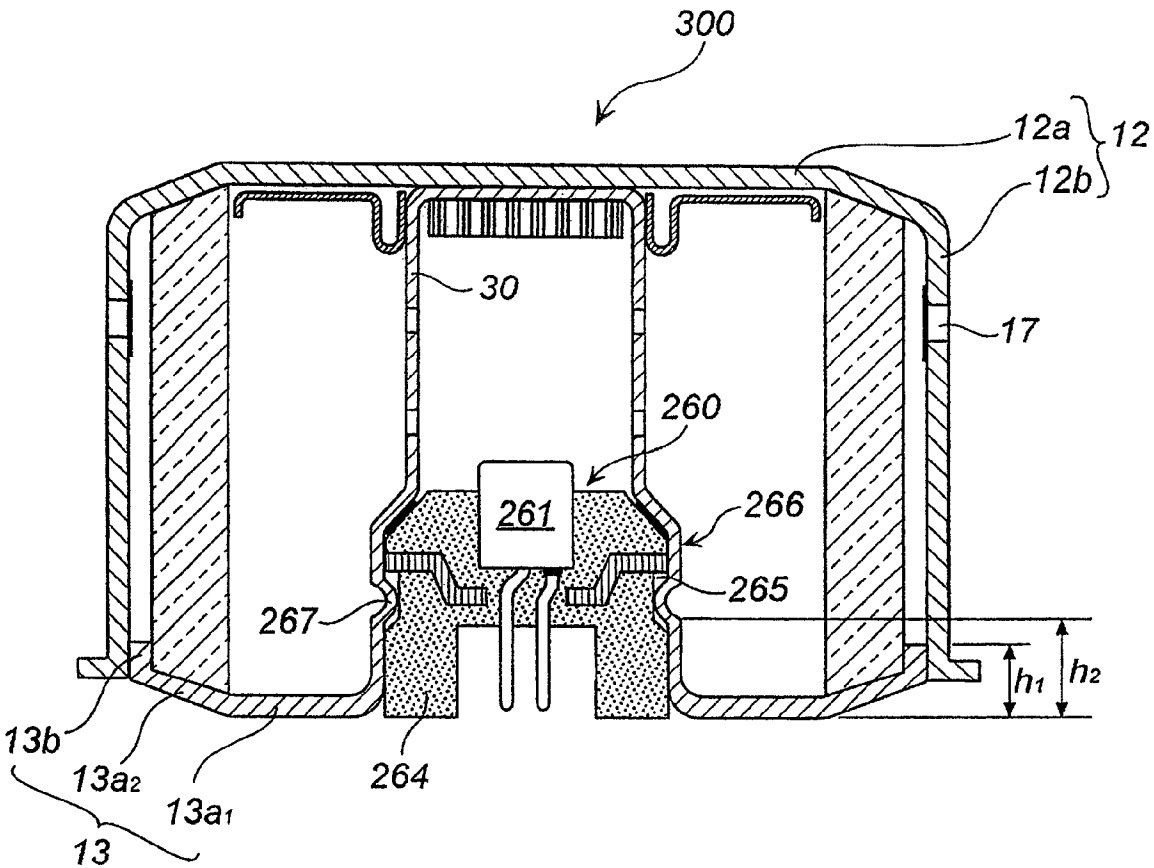
FIG. 6 shows a vertical cross-sectional view of an apparatus (gas generator) of another embodiment for FIG. 5.

(4) Gas Generator of FIG. 6

FIG. 6 is a vertical cross-sectional view of a gas generator of another embodiment of the present invention. A gas generator 300 of FIG. 6 has a structure identical to that of the gas generator 200 of FIG. 5, except that a circumferential wall 12*b* of a diffuser shell is made longer, a circumferential wall 13*b* of a closure shell is made shorter, the diameter of the bottom plate of the closure shell is decreased, and the joining state of a diffuser shell 12 and closure shell 13 is different. The bottom plate of the closure shell is divided into a flat portion $13a_1$ and an inclined portion $13a_2$.

A height ($h_1$) of a circumferential wall surface 13*b* of the closure shell 13 and a height ($h_2$) of a deformed portion (annular convex portion 267) of the igniter collar, based on a flat bottom surface (flat portion $13a_1$) of the closure shell 13, satisfy the relationship: $h_2>h_1$. The height ($h_2$) of the annular convex portion 267 of the igniter collar is preferably a height of the center or lower end; the height shown in the drawing is that of the lower end of the annular convex portion 267.

An igniter collar 266 and a resin portion 264 are fixed by deforming the igniter collar 266 to engage it with a groove portion 265 of the resin portion 264. In this process, an arm portion of the tool used for deformation applies pressure and causes deformation upon inserting the igniter collar 266 from the outside, as shown in Step (e) of FIG. 3. Therefore, where the aforementioned relationship $h_2>h_1$ is satisfied, the circumferential wall 13*b* does not become an obstacle when the igniter collar 266 is inserted by the arm portion. Therefore, the deformation operation is facilitated.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An apparatus provided with an igniter assembly, comprising:

an igniter main body having an ignition portion, provided with an ignition agent and an electroconductive pin, a resin portion surrounding at least part of the igniter main body, and a substantially cylindrical igniter collar fixed to an outer surface of the resin portion, the igniter assembly being disposed in an opening formed in a bottom portion of a housing, the igniter collar being integrally formed with the bottom portion of the housing and extending into the housing from a circumferential edge of the opening in an axial direction of the housing, the igniter collar having a first reduced diameter portion and a second reduced diameter portion formed at a position away from the first reduced diameter portion in the axial direction, the second reduced diameter portion engaging with a concave portion formed in the resin portion, and the resin portion being fixed to the igniter collar by the first reduced diameter portion and the second reduced diameter portion.

2. The apparatus provided with an igniter assembly according to claim 1, wherein the igniter assembly has an annular holding plate having a hole and embedded in the resin portion;

the annular holding plate is positioned between the first and second reduced diameter portions, and the annular holding plate is disposed so that the electroconductive pin passes through the hole; and an outer diameter of the annular holding plate is larger than inner diameters of the first and second diameter portions, and an inner diameter of the annular holding plate is smaller than an outer diameter of the ignition portion of the igniter main body.

3. The apparatus provided with an igniter assembly according to claim 1, wherein an annular holding plate protrudes from an outer surface of the resin portion and forms at least part of a wall surface of a concave portion of the resin portion.

4. The apparatus provided with the igniter assembly according to claim 3, wherein an inner diameter of the first reduced diameter portion is larger than an outer diameter of the ignition portion of the igniter assembly and smaller than an outer diameter of the resin portion, and the resin portion abuts against the first reduced diameter portion.

5. The apparatus provided with an igniter assembly according to claim 1, wherein a sealing member is inserted between the second reduced diameter portion of the igniter collar and the concave portion of the resin portion.

6. The apparatus provided with an igniter assembly according to claim 1, wherein the housing is formed by joining a diffuser shell having a gas discharge port and a closure shell, the closure shell has at least a flat bottom surface and a circumferential wall surface, and a height ($h_1$) of the circumferential wall surface of the closure shell and a height ($h_2$) of the second reduced diameter portion of the igniter collar, based on the flat bottom surface of the closure shell, satisfy the relationship $h_2>h_1$.

7. An apparatus provided with an igniter assembly, comprising:

an igniter main body having an ignition portion, provided with an ignition agent, and an electroconductive pin, a resin portion surrounding at least part of the igniter main body and a substantially cylindrical igniter collar fixed to an outer surface of the resin portion, the igniter assembly being disposed in an opening formed in a bottom portion of a housing, and surrounded by a bottomed tubular member integrally formed with the bottom portion of the housing and extending into the housing from a circumferential edge of the opening along an axial direction of the housing, the igniter collar having a first reduced diameter portion and a second reduced diameter portion formed at a position away from the first reduced diameter portion in the axial direction, the second reduced diameter portion engaging with a concave portion formed in the resin portion, the resin portion being fixed to the igniter collar by the first reduced diameter portion and the second reduced diameter portion.

8. The apparatus provided with an igniter assembly according to claim 7, wherein the igniter assembly has an annular holding plate having a hole and embedded in the resin portion;

the annular holding plate is positioned between the first and second reduced diameter portions, and the annular holding plate is disposed so that the electroconductive pin passes through the hole; and an outer diameter of the annular holding plate is larger than inner diameters of the first and second reduced diameter portions, and an inner diameter of the annular holding plate is smaller than an outer diameter of the ignition portion of the igniter main body.

9. The apparatus provided with an igniter assembly according to claim 7, wherein an annular holding plate protrudes from an outer surface of the resin portion and forms at least part of a wall surface of a concave portion of the resin portion.

10. The method of assembling an apparatus provided with the igniter assembly according to claim 9, wherein an annular holding plate is embedded in the resin portion, an outer diameter of the annular holding plate is larger than inner diameters of the first reduced diameter portion and the second reduced diameter portion, and in which an inner diameter of the annular holding plate is smaller than an outer diameter of the ignition portion of the igniter main body, and the annular holding plate of the resin portion is positioned between the first reduced diameter portion and the second reduced diameter portion.

11. The apparatus provided with an igniter assembly according to claim 7, a sealing member is inserted between the second reduced diameter portion of the igniter collar and the concave portion of the resin portion.

12. The apparatus provided with an igniter assembly according to claim 7, wherein the housing is formed by joining a diffuser shell having a gas discharge port and a closure shell, the closure shell has at least a flat bottom surface and a circumferential wall surface, and a height ($h_1$) of the circumferential wall surface of the closure shell and a height ($h_2$) of the second reduced diameter portion of the igniter collar, based on the flat bottom surface of the closure shell, satisfy the relationship $h_2>h_1$.

* * * * *